US009004860B2

(12) United States Patent
Van Houten

(10) Patent No.: US 9,004,860 B2
(45) Date of Patent: Apr. 14, 2015

(54) FREE-TIPPED AXIAL FAN ASSEMBLY

(75) Inventor: Robert J. Van Houten, Winchester, MA (US)

(73) Assignee: Robert Bosch GmbH, Stuttgart (DE)

( * ) Notice: Subject to any disclaimer, the term of this patent is extended or adjusted under 35 U.S.C. 154(b) by 834 days.

(21) Appl. No.: 13/035,440

(22) Filed: Feb. 25, 2011

(65) Prior Publication Data

US 2011/0211949 A1 Sep. 1, 2011

Related U.S. Application Data

(60) Provisional application No. 61/308,375, filed on Feb. 26, 2010.

(51) Int. Cl.
*F04D 29/38* (2006.01)
*F04D 29/68* (2006.01)

(52) U.S. Cl.
CPC ..... *F04D 29/384* (2013.01); *F04D 29/681* (2013.01)

(58) Field of Classification Search
USPC ..... 415/222
See application file for complete search history.

(56) References Cited

U.S. PATENT DOCUMENTS

| | | | | |
|---|---|---|---|---|
| 5,769,607 | A | 6/1998 | Neely et al. | |
| 6,116,856 | A | 9/2000 | Karadgy et al. | |
| 6,595,744 | B2 * | 7/2003 | Van Houten | 415/173.1 |
| 7,794,204 | B2 | 9/2010 | Stevens et al. | |
| 2002/0182071 | A1 | 12/2002 | Belady | |
| 2007/0243068 | A1 * | 10/2007 | Wadia et al. | 416/223 R |
| 2007/0280829 | A1 * | 12/2007 | Stevens et al. | 416/189 |
| 2008/0101964 | A1 | 5/2008 | Iwase et al. | |
| 2008/0118379 | A1 * | 5/2008 | Uchise et al. | 417/423.1 |
| 2008/0219849 | A1 * | 9/2008 | Decker et al. | 416/223 R |

FOREIGN PATENT DOCUMENTS

| | | | |
|---|---|---|---|
| GB | 1491556 | A | 11/1977 |
| JP | 0656092 | A | 3/1994 |

OTHER PUBLICATIONS

John D. Anderson, Fundamentals of Aerodynamics, 2001, McGraw-Hill, 3rd Edition, p. 278-281.*

International Search Report and Written Opinion for corresponding International Application No. PCT/US2011/026264 mailed on May 30, 2011.

English translation of Office action dated Nov. 14, 2014 for Chinese Appl. No. 201180019425.1, 6 pages.

* cited by examiner

*Primary Examiner* — Nathaniel Wiehe
*Assistant Examiner* — Brian O Peters
(74) *Attorney, Agent, or Firm* — Michael Best & Friedrich LLP

(57) ABSTRACT

A free-tipped axial fan assembly includes fan having a blade tip geometry which provides a desired blade loading in the presence of a tip gap. The maximum camber exhibits a sudden and significant increase as the blade tip radius R is closely approached in the direction of increasing radial position. In some constructions, the maximum camber at the blade tip radius R is at least 10 percent greater than the maximum camber at a radial position r where r/R=0.95. In some constructions, the blade angle increases by more than 0.01 radians from a radial position r where r/R=0.95 to the blade tip radius R. The maximum camber at the blade tip radius R is at least 0.06 times the chord length in some constructions.

17 Claims, 9 Drawing Sheets

Section A – A

FREE-TIPPED AXIAL FAN ASSEMBLY

CROSS-REFERENCE TO RELATED APPLICATIONS

This application claims priority to U.S. Provisional Patent Application No. 61/308,375, filed Feb. 26, 2010, the entire contents of which are hereby incorporated by reference.

BACKGROUND

This invention relates generally to free-tipped axial-flow fans, which may be used as automotive engine-cooling fans, among other uses.

Engine-cooling fans are used in automotive vehicles to move air through a set of heat exchangers which typically includes a radiator to cool an internal combustion engine, an air-conditioner condenser, and perhaps additional heat exchangers. These fans are generally enclosed by a shroud which serves to reduce recirculation and to direct air between the fan and the heat exchangers.

The fans are typically injection-molded in plastic, a material with limited mechanical properties. Plastic fans exhibit creep deflection when subject to rotational and aerodynamic loading at high temperature. This deflection must be accounted for in the design process.

Although some engine-cooling fans have rotating tip bands connecting the tips of all the blades, many are free-tipped (i.e., the tips of the blades are free from connection with one another). Free-tipped fans are designed to have a tip gap, or running clearance, between the blade tips and the shroud barrel. This tip gap must be sufficient to allow for both manufacturing tolerances and the maximum deflection that may occur over the service life of the fan assembly.

Often free-tipped fans are designed to have a constant-radius tip shape, and to operate in a shroud barrel which is cylindrical in the area of closest clearance with the fan blades. In other cases, the tip radius is non-constant. For example, U.S. Pat. No. 6,595,744 describes a free-tipped engine-cooling fan in which the blade tips are shaped to conform to a flared shroud barrel. In either case, a significant tip gap is required, typically between 1 and 1.5 percent of the fan diameter.

Although tip gap will always reduce fan efficiency and increase fan noise to some extent, free-tipped fans offer certain advantages over banded fans, such as reduced material cost, reduced mass, and better balance. Thus, there is a need for a free-tipped fan which minimizes adverse performance effects presented by the lack of a tip band. In particular, there is a need for a fan which can develop the design blade loading in the presence of a tip gap. If a fan is designed without accounting for the gap, its actual loading will be different from the design loading, and the efficiency and noise performance of the fan will be compromised.

SUMMARY

The present invention provides, in one aspect, a free-tipped axial fan assembly comprising a fan and a shroud, the fan having a blade tip radius R equal to the maximum radial extent of the blade trailing edge, and a diameter D equal to twice the blade tip radius R. Each of the blades has a sectional geometry which at every radial position has a mean line, the mean line having a chord length, a blade angle, and a camber distribution, the camber distribution having a maximum camber. The shroud comprises a shroud barrel surrounding at least a portion of the blade tips, the assembly having a running clearance between the shroud barrel and the blade tips. The maximum camber of each of the plurality of blades exhibits an abrupt and significant increase as the blade tip radius R is closely approached in the direction of increasing radial position.

The present invention provides, in one aspect, a free-tipped axial fan assembly comprising a fan and a shroud, the fan having a blade tip radius R equal to the maximum radial extent of the blade trailing edge, and a diameter D equal to twice the blade tip radius R. Each of the blades has a sectional geometry which at every radial position has a mean line, the mean line having a chord length, a blade angle, and a camber distribution, the camber distribution having a maximum camber. The shroud comprises a shroud barrel surrounding at least a portion of the blade tips, the assembly having a running clearance between the shroud barrel and the blade tips. The maximum camber at the blade tip radius R is at least 10 percent larger than the maximum camber at a radial position r where r/R=0.95.

In another aspect of the invention, the maximum camber at the blade tip radius R is at least 20 percent larger than the maximum camber at a radial position r, where r/R=0.95.

In another aspect of the invention, the maximum camber at the blade tip radius R is at least 30 percent larger than the maximum camber at a radial position r, where r/R=0.95.

In other aspects of the invention, the free-tipped axial fan assembly is further characterized in that the maximum camber, divided by chord, at the blade tip radius R is at least 0.06.

In other aspects of the invention, the free-tipped axial fan assembly is further characterized in that the blade angle increases by at least 0.01 radians from a radial position r where r/R=0.95 to the blade tip radius R.

In other aspects of the invention, the free-tipped axial fan assembly is further characterized in that the blade angle increases by at least 0.02 radians from a radial position r where r/R=0.95 to the blade tip radius R.

In other aspects of the invention, the free-tipped axial fan assembly is further characterized in that the blade angle increases by at least 0.04 radians from a radial position r where r/R=0.95 to the blade tip radius R.

In other aspects of the invention, the free-tipped axial fan assembly is further characterized in that the shroud barrel is flared, and the blade tip leading edge is at a larger radius than the blade tip trailing edge.

In other aspects of the invention, the free-tipped axial fan assembly is further characterized in that the tip gap is greater than 0.007 times the fan diameter D and less than 0.02 times the fan diameter D.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
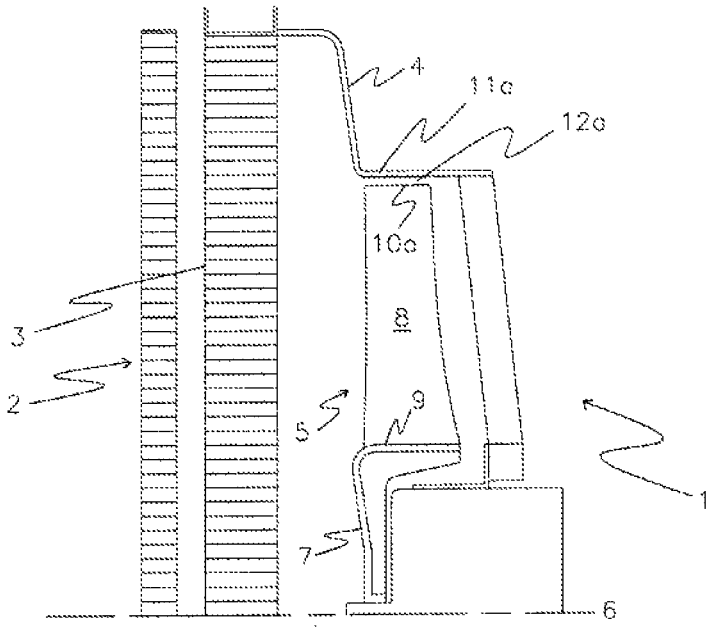
Figure 1a Prior Art
FIG. 1*a* is a schematic view of a free-tipped axial fan assembly, showing a constant-radius blade tip and a cylindrical shroud barrel. The free-tipped axial fan assembly is configured as an engine-cooling fan assembly.

FIG. 1*a* shows a free-tipped axial fan assembly 1. In the illustrated construction, the free-tipped axial fan assembly 1 is an engine-cooling fan assembly mounted adjacent to at least one heat exchanger 2. In some constructions, the heat exchanger(s) 2 includes a radiator 3, which cools an internal combustion engine (not shown) as fluid circulates through the radiator 3 and back to the internal combustion engine. In alternatively-powered vehicles, the fan assembly 1 could be used in conjunction with one or more heat exchangers to cool batteries, motors, etc. A shroud 4 guides cooling air from the radiator 3 to a fan 5. The fan 5 rotates about an axis 6 and comprises a hub 7 and a plurality of generally radially-extending blades 8. The end of each blade 8 that is adjacent to the hub 7 is a blade root 9, and the outermost end of each blade 8 is a blade tip 10*a*. The blade tips 10*a* are surrounded by a barrel 11*a* of the shroud 4. A tip gap 12*a* provides a running clearance between the blade tips 10*a* and the shroud barrel 11*a*.

Although the fan 5 may be in a "puller" configuration and located downstream of the heat exchanger(s) 2, in some cases the fan 5 is a "pusher", and located upstream of the heat exchanger(s) 2. Although FIG. 1*a* represents most accurately a puller configuration, it could be interpreted as a pusher, although in such a configuration, the position of the radiator 3 within the set of heat exchangers 2 would be reversed.

FIG. 1*a* shows each blade tip 10*a* to be at a constant radius, and the shroud barrel 11*a* to be generally cylindrical in the region of close proximity to the blade tips 10*a*. This example shows the blade tips 10*a* in close proximity with the shroud barrel 11*a* along their entire axial length. In other cases, the blade tips 10*a* are allowed to protrude from the barrel 11*a* (e.g., extending out to the left in FIG. 1*a*), so that only the rearward portion of each blade tip 10*a* (the blade portion on the right in FIG. 1*a*) has a small clearance gap with the shroud barrel 11*a*.

Figure 2C:
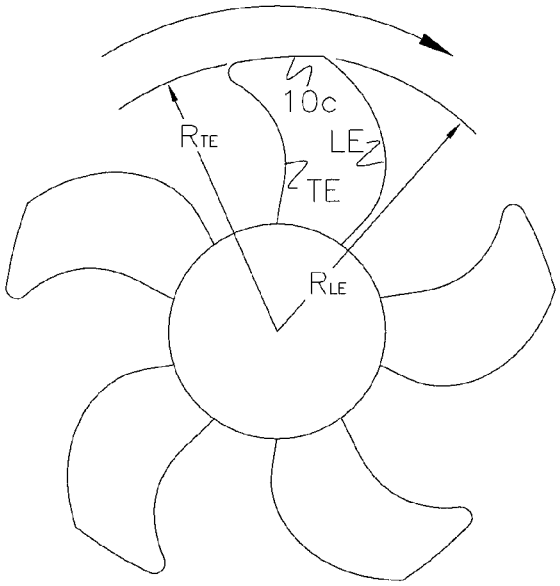
FIG. 2*c* shows an axial projection of a fan with a blade tip which conforms to a flared shroud, where the blade tip is rounded at the trailing edge.
Figure 2A:
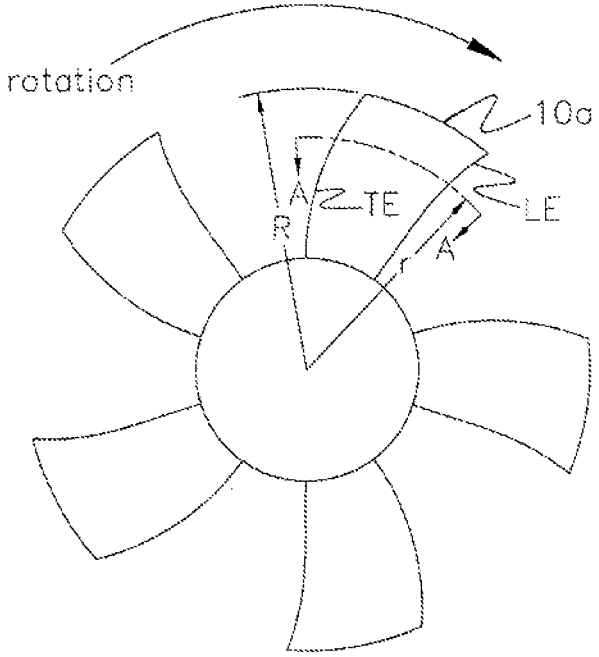
Figure 2a Prior Art
FIG. 2*a* shows an axial projection of a fan with a constant-radius blade tip, with definitions of various geometric parameters.

FIG. 2*a* is an axial projection of the free-tipped fan of FIG. 1*a* having a constant-radius blade tip 10*a*. The rotation is clockwise in the drawing, and the fan leading edge LE and trailing edge TE are as shown. The overall fan radius is equal to the blade tip radius R. The parameters describing the geometry of the blade are defined as a function of radial position r, which can be non-dimensionalized on the blade tip radius R. Blade sectional geometry is defined in terms of cylindrical sections such as that indicated by section A-A.

Figure 1B:
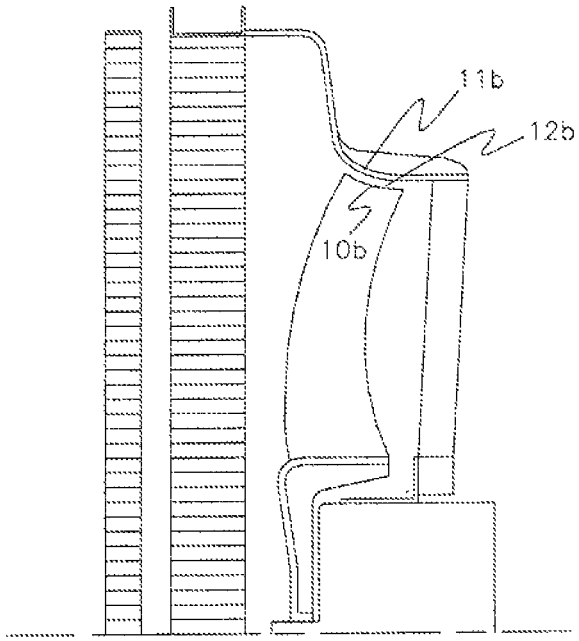
FIG. 1*b* is a schematic view of a free-tipped axial fan assembly, showing a blade tip which conforms to the shape of a flared shroud barrel. The free-tipped axial fan assembly is configured as an engine-cooling fan assembly.

FIG. 1*b* illustrates a free-tipped axial fan assembly that is configured as an engine-cooling fan assembly similar to that of FIG. 1*a*, with the following exceptions. Rather than being substantially cylindrical, the shroud barrel 11*b* is flared, and the blade tips 10*b* conform to the flared shape of the shroud barrel 11*b*. A tip gap 12*b* provides running clearance.

Figure 2B:
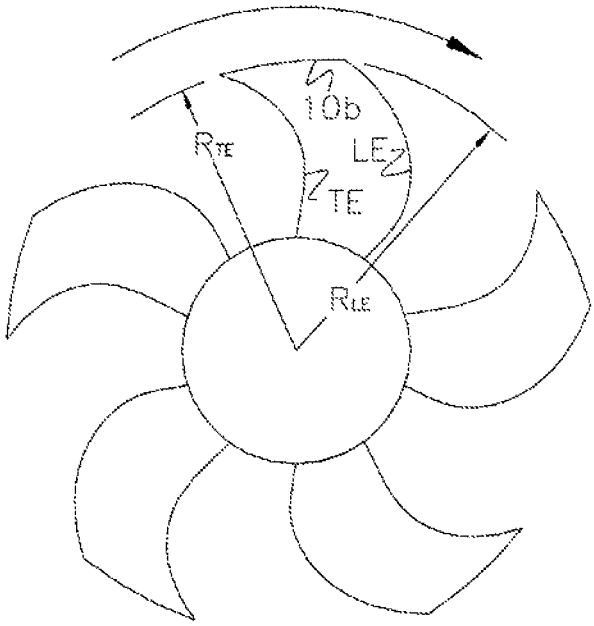
FIG. 2*b* shows an axial projection of a fan with a blade tip which conforms to a flared shroud, with definitions of various geometric parameters.

FIG. 2*b* shows a front view of the free-tipped fan of FIG. 1*b* in which the blade tips 10*b* conform to a flared shroud 11*b*. The radius of each blade tip 10*b* at the leading edge LE is $R_{LE}$ and at the trailing edge TE is $R_{TE}$, where $R_{LE}$ exceeds $R_{TE}$. In the case of a fan with flared blade tips, the trailing edge radius $R_{TE}$ is considered to be the nominal blade tip radius. Thus, unless specifically indicated otherwise, wherever "blade tip radius", "blade tip radius R", or "fan radius" is used in the following description, it is meant to encompass both the constant blade tip radius of a fan with non-flared blade tips and the nominal blade tip radius of a fan with flared blade tips.

Figure 1C:
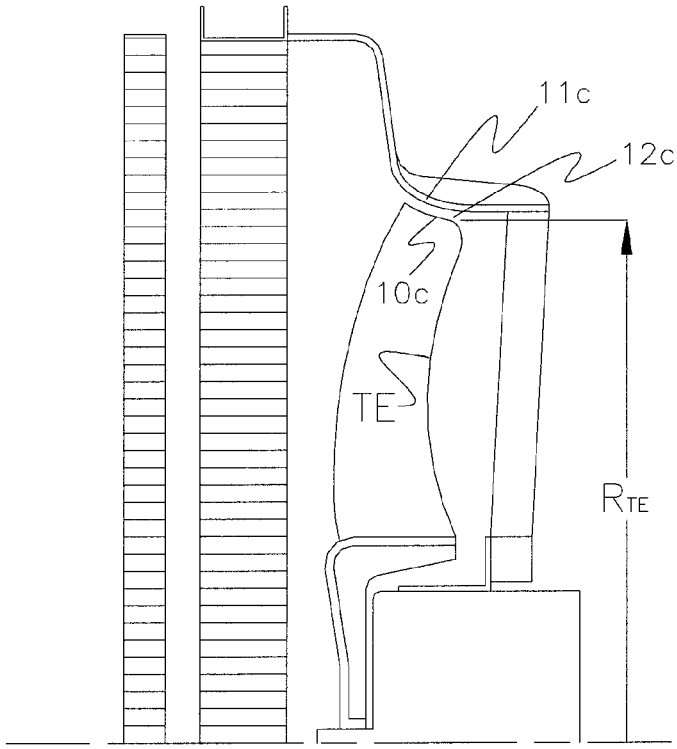
FIG. 1*c* is a schematic view of a free-tipped axial fan assembly, showing a blade tip which conforms to the shape of a flared shroud barrel, where the blade tip is rounded at the trailing edge.

FIG. 1*c* illustrates a free-tipped axial fan assembly that is configured as an engine-cooling fan assembly similar to that of FIG. 1*b*, where the shroud barrel 11*c* is flared, and the blade tips 10*c* conform to the flared shape of the shroud barrel 11*c*. Here the trailing edge TE at the blade tip is locally rounded.

FIG. 2*c* shows a front view of the free-tipped fan of FIG. 1*c* in which the blade tips 10*c* conform to a flared shroud 11*c*, and the blade trailing edge TE is rounded at the blade tips. The trailing edge radius $R_{TE}$ of each blade tip 10*c* is taken to be the radius of the blade tip at the trailing edge TE where the tip gap is at the nominal or substantially minimum value. In the case of a fan with flared blade tips where the blade trailing edge is locally rounded, the trailing edge radius $R_{TE}$ is considered to be the nominal blade tip radius.

Unless specifically noted otherwise, the description below and the accompanying drawings refer generally to free-tipped fans, and are not necessarily limited to the particular shapes and configurations of the fans illustrated in FIGS. 1*a*-2*c*. In the detailed description below, fan diameter D is taken to be two times the blade tip radius R as shown in FIG. 2*a*, or two times the trailing edge radius $R_{TE}$ as shown in FIGS. 2*b* and 2*c*. Tip gaps 12*a*, 12*b*, 12*c* may be expressed in terms of fan diameter for any of the fans shown in FIGS. 1*a*-2*c*. At the axial position where it is a minimum, the tip gap 12*a*, 12*b*, 12*c* between the blade tip 10*a*, 10*b*, 10*c* and the shroud barrel 11*a*, 11*b*, 11*c* is between about 0.007 and about 0.02 times the fan diameter D. FIGS. 1*a*, 1*b*, and 1*c* show the tip gaps 12*a*, 12*b*, 12*c* to be approximately 0.01 times the fan diameter D.

Figure 3:
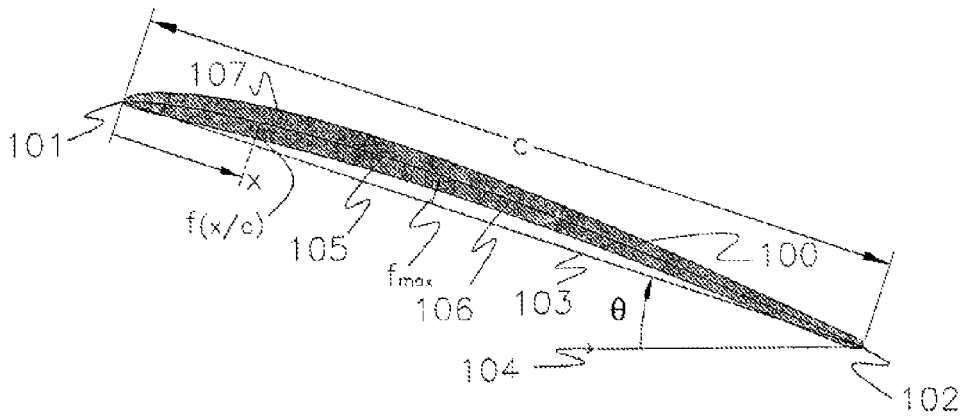
Figure 3 Prior Art
FIG. 3 is a cylindrical cross-section of a fan blade, taken along line A-A of FIG. 2*a*, with definitions of various geometric parameters.

FIG. 3 shows cylindrical cross-section A-A at a radial position r of the fan shown in FIG. 2*a*. The blade section 100 has a leading edge 101 and a trailing edge 102. A nose-tail line 103 is a straight line between the leading edge 101 and the trailing edge 102. The length of the nose-tail line is defined as the chord c, and the chordwise position x is measured from the leading edge 101 along the nose-tail line 103. Blade angle θ is defined as the angle between the rotation plane 104 and the nose-tail line 103. A mean line 105 of the blade is defined as the line that lies midway between opposed "lower" and "upper" surfaces 106, 107. More precisely, the distance from a point on the mean line 105 to the upper surface 107, measured normal to the mean line 105, is equal to the distance from that point on the mean line 105 to the lower surface 106, measured normal to the mean line 105. The geometry of the mean line 105 can be described as a function of the non-dimensionalized chordwise position x/c—where the distance x along the nose-tail line 103 is divided by the chord c. For example, the camber fat any non-dimensional chordwise position x/c is the distance between the nose-tail line 103 and the mean line 105 at that position, measured normal to the nose-tail line 103. The maximum camber (or "max camber") $f_{max}$ at any radial position r is the largest value of camber fat that radial position r.

When a fan is operating, there exists a high pressure on the pressure side of the blade, and a low pressure on the suction side of the blade. At the tip of a free-tipped fan, this pressure difference causes there to be a leakage flow from the pressure side to the suction side through the tip gap. This reduces the pressure difference across the blade tip, and causes a tip vortex to form. At every chordwise position along the tip, the local leakage contributes to the vortex, which strengthens from the tip leading edge to the tip trailing edge before being convected downstream.

Figure 4:
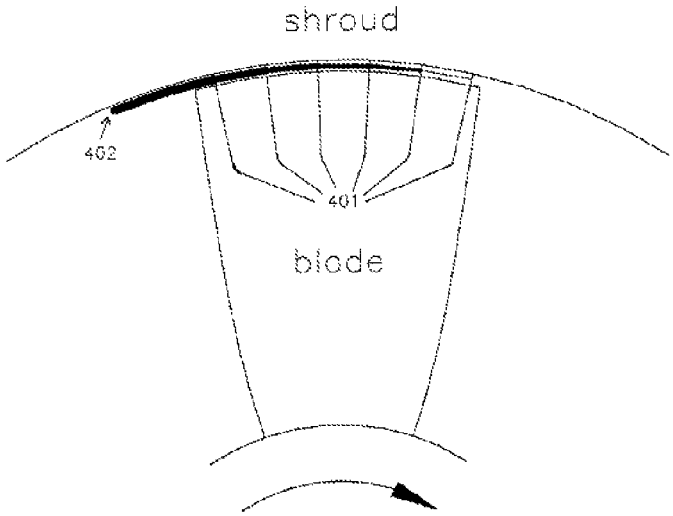
FIG. 4 is a schematic view of the tip vortex caused by a tip gap.

FIG. 4 is a schematic diagram illustrating the strengthening of the tip vortex in terms of circulation. It shows that the blade's bound circulation 401 is only imperfectly transferred to the shroud. Part of that bound circulation feeds a tip vortex 402, which grows in strength as it is fed more voracity from the blade. This increase in strength is depicted schematically by the thickening of the line representing the tip vortex.

Figure 5:
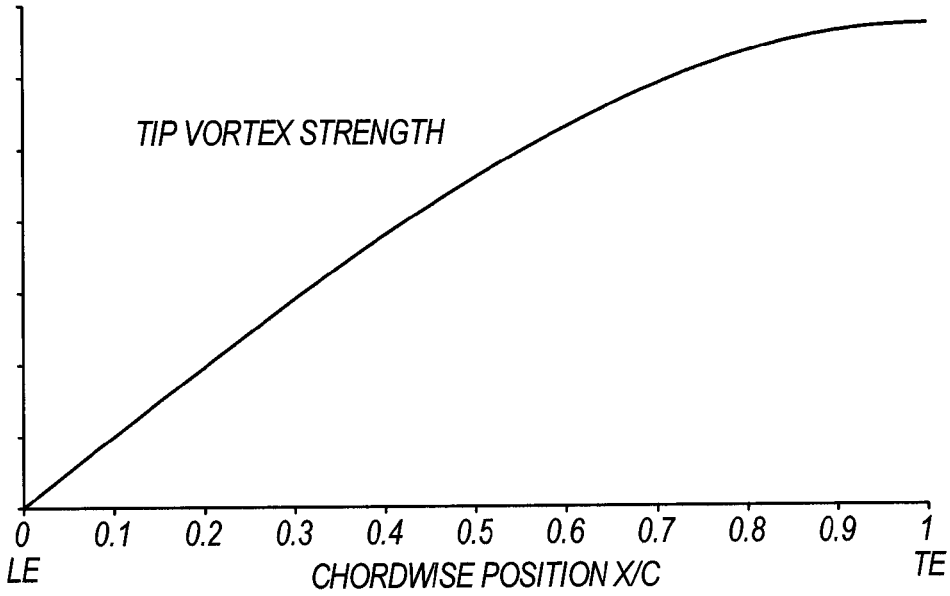
FIG. 5 shows a plot of tip vortex strength as a position of chordwise position at the blade tip.

FIG. 5 shows a plot of the strength of the tip vortex 402 as a function of chordwise position (x/c). The strength is zero at the leading edge, initially grows rapidly, and then grows slowly towards the trailing edge, due to the fact that the blade loading must be reduced to zero at the trailing edge.

Figure 6:
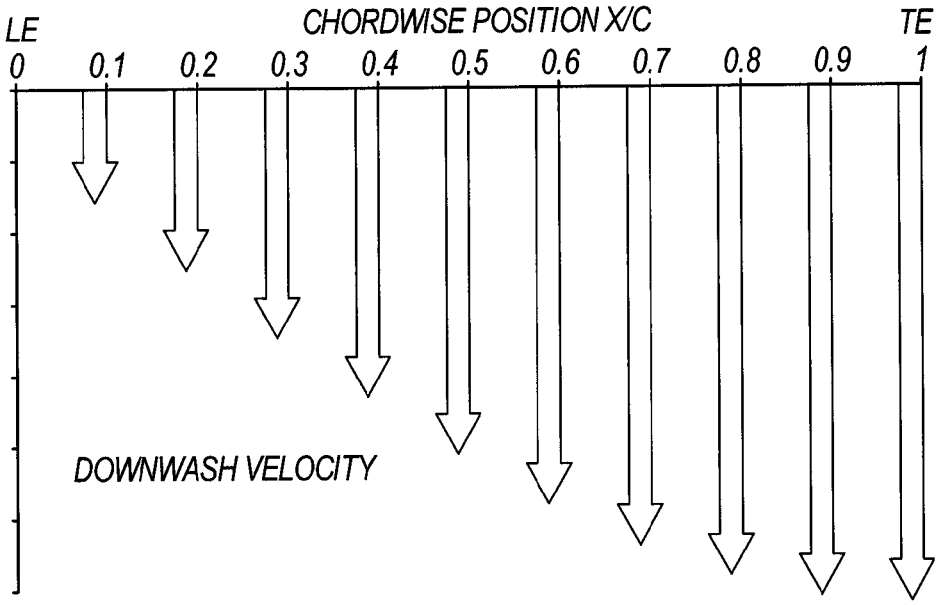
FIG. 6 is a plot of the downwash velocity at the blade tip due to the tip vortex.

FIG. 6 is a plot of the velocity at the blade tip induced by the tip vortex 402. This velocity is referred to as a downwash velocity $V_{downwash}$, and reflects the local strength of the tip vortex 402.

Figure 7:
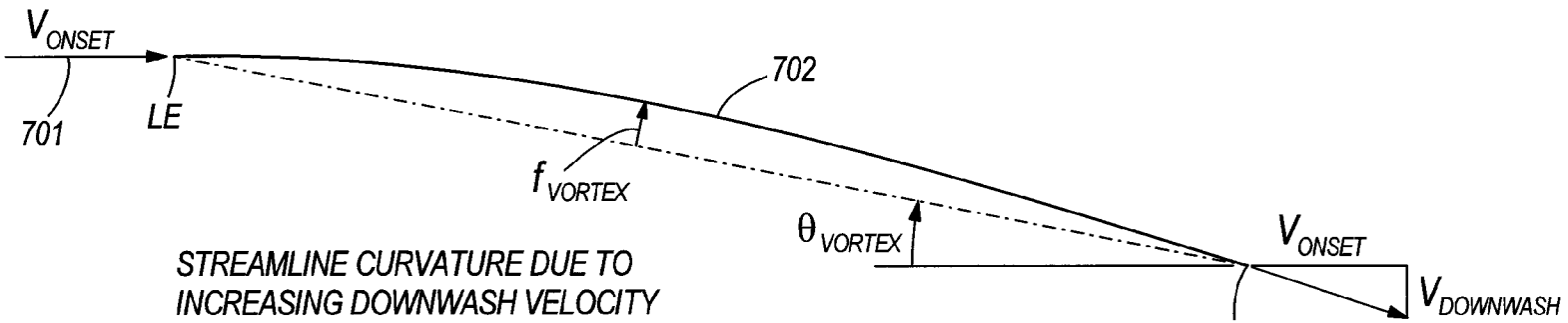
FIG. 7 is a schematic view of the streamline curvature induced by the downwash velocity.

FIG. 7 is a schematic view of the streamline curvature at the blade tip induced by the tip vortex 402. The onset flow 701 is the local velocity due to rotation and the fan's delivered air flow. For simplicity, the velocity $V_{onset}$ of the onset flow 701 is assumed here to be constant along the blade chord. The local slope of the streamline 702 is the ratio of the local downwash velocity $V_{downwash}$ to the local onset flow velocity $V_{onset}$. The increase in the downwash velocity $V_{downwash}$ with chordwise position, as shown in FIG. 6, causes curvature of the streamline. One can describe this streamline in terms of its camber $f_{vortex}$ and angle $\theta_{vortex}$, where $f_{vortex}$ and $\theta_{vortex}$ are measured similarly to corresponding characteristics of a mean line.

Figure 8:
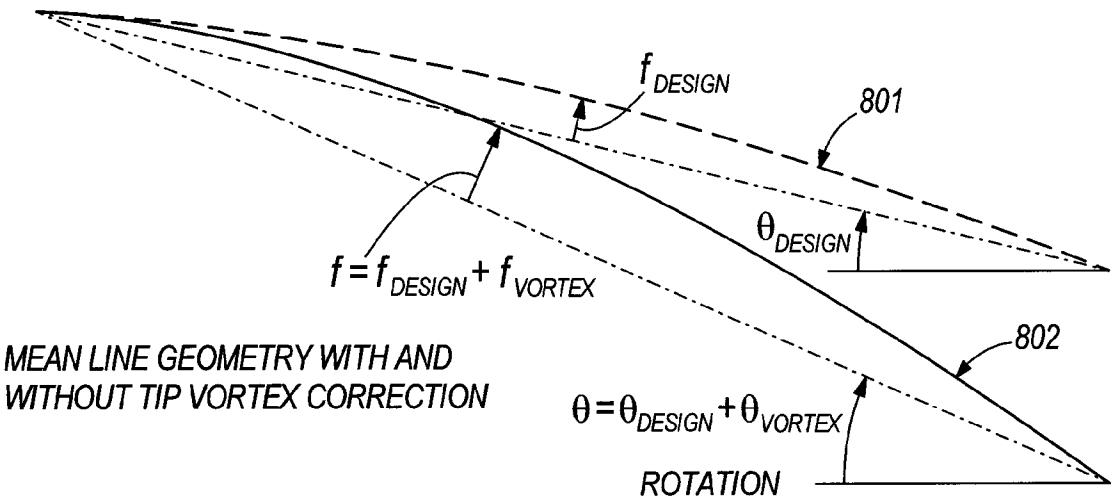
FIG. 8 shows a blade tip mean line that would be required to generate the design loading in the absence of a tip vortex, and the mean line required to generate that loading in the presence of the streamline curvature induced by the tip vortex.

FIG. 8 shows two representations of mean line geometry. The dashed line 801 represents a typical blade tip mean line that might be suitable for a banded fan, where there is no tip gap and therefore no tip vortex. The maximum camber is designated as $f_{design}$ and the blade angle is designated as $\theta_{design}$. The solid line 802 represents the blade tip mean line that will generate the design loading in the presence of a tip vortex. The camber f is approximately the sum of the design camber $f_{design}$ and the camber due to the tip vortex $f_{vortex}$, as shown in FIG. 7. Likewise, the blade angle θ is approximately the sum of the design angle $\theta_{design}$ and the angle due to the tip vortex $\theta_{vortex}$.

Because the velocity induced by a tip vortex falls off with distance from the vortex, the required correction to the design blade geometry is reduced at radial positions r significantly less than the blade tip radius R. Typically the correction is quite small at r/R=0.95.

Figure 9A:
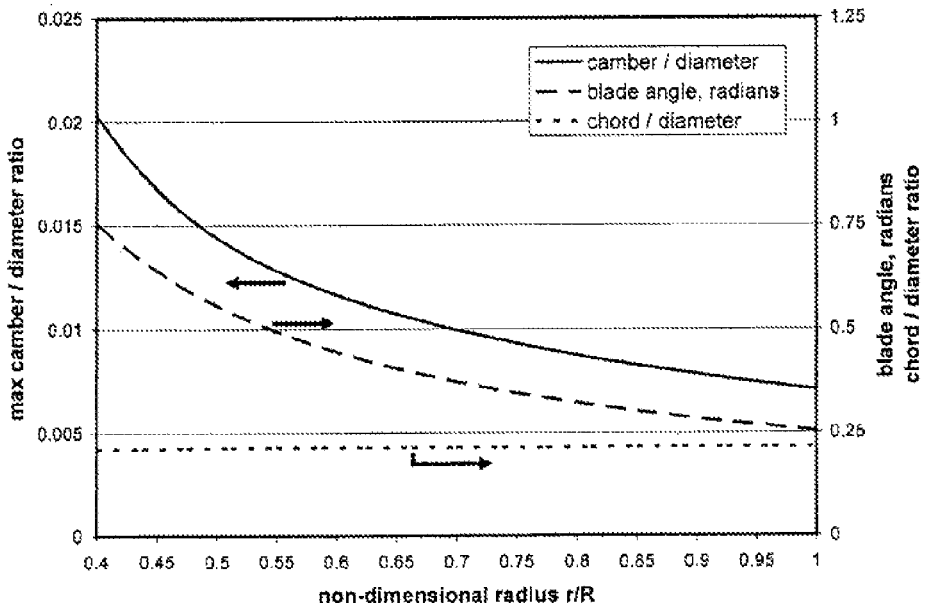
Figure 9a Prior Art
FIGS. 9*a* and 9*b* show plots of maximum camber, blade angle, and chord as a function of radial position for a prior-art free-tipped fan and an improved free-tipped fan according to the present invention.
Figure 9B:
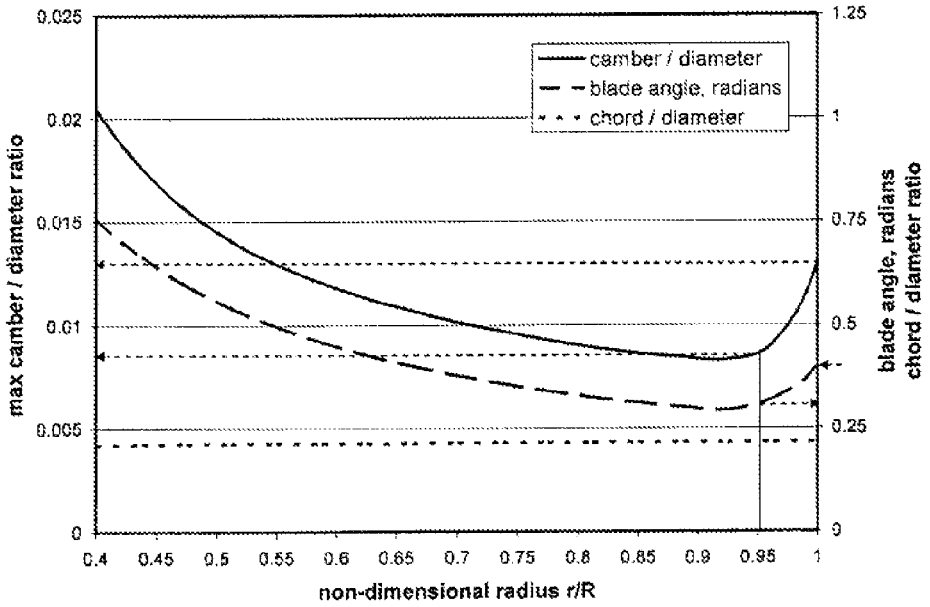

FIGS. 9*a* and 9*b* show max camber, chord, and blade angle as a function of radial position r for a prior-art fan and for a fan according to one construction of the invention. The curves begin at the radial position of the root of the blade, which is the radius of the hub of the fan. The ratio of the hub radius to the blade tip radius is called the hub ratio, which in the case of the fans of FIGS. 9*a* and 9*b* is 0.4. Both of the fans represented by the graphs of FIGS. 9*a* and 9*b* have a constant-radius blade tip, so the geometry variables are defined from the hub radius of r/R=0.4 to the blade tip radius r/R=1.0. Max camber and chord are non-dimensionalized on the fan diameter D. Blade angle is given in radians. The arrows indicate that max camber is read on the left axis, and blade angle and chord are read on the right axis. As shown in FIG. 9*a*, the prior-art fan has max camber and blade angle that decrease with increasing radial position from the root of the blade to the blade tip radius.

The improved fan of FIG. 9*b* is designed according to the present invention, with a modified tip geometry to account for the effects of the tip clearance. Both the max camber and the blade angle increase significantly with increasing radial position r as the blade tip radius R is closely approached. For example, when comparing the max camber at a radial position r equal to 95 percent of the blade tip radius R (r/R=0.95) to the max camber at the blade tip radius (r/R=1.0), the max camber at the blade tip is about 54 percent larger. Also, the blade angle at the blade tip radius is about 0.11 radians greater than the blade angle at a radial position r where r/R=0.95. At the blade tip radius, the max camber-to-diameter ratio is about 0.0131, and the chord-to-diameter ratio is about 0.215, so the max camber-to-chord ratio is about 0.061.

Figure 10A:
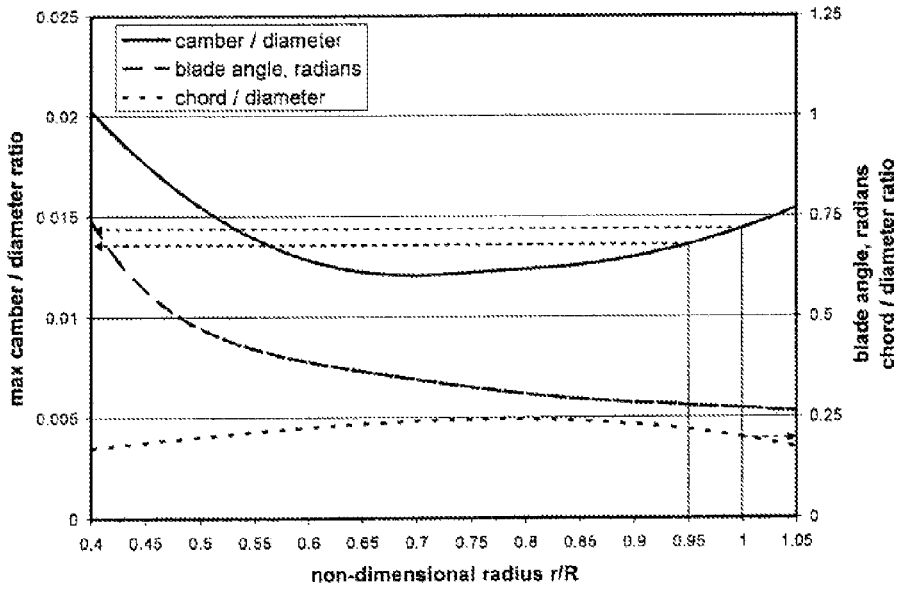
Figure 10a Prior Art
FIGS. 10*a* and 10*b* show plots of maximum camber, blade angle, and chord as a function of radial position for another prior-art free-tipped fan and an improved free-tipped fan according to the present invention.
Figure 10B:
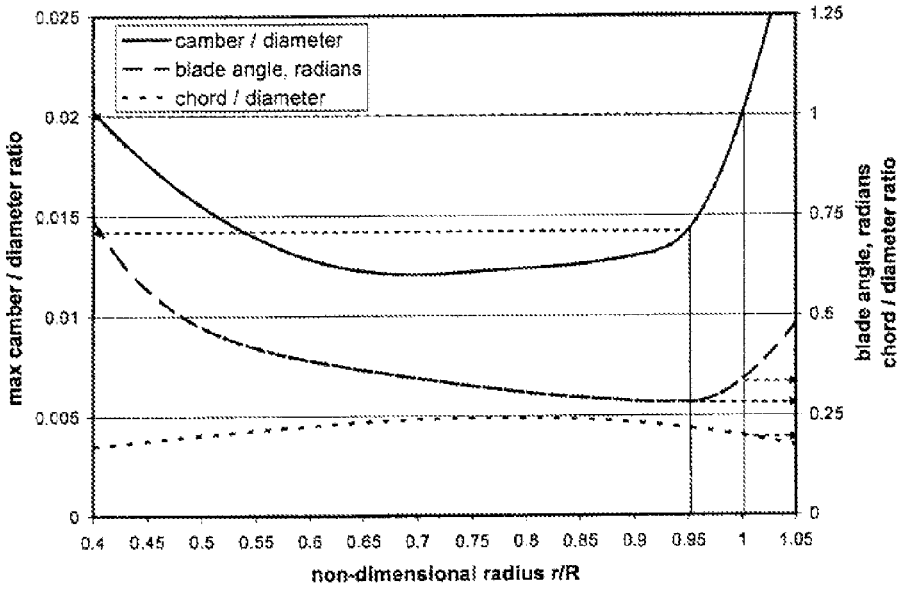

FIGS. 10*a* and 10*b* show max camber, chord, and blade angle as a function of radial position for another prior-art fan and for another fan according to one construction of the invention. Both of the fans represented by the graphs of FIGS. 10*a* and 10*b* have flared blade tips and operate in a flared shroud, so the geometry is defined from a hub radius of r/R=0.4 to a radial position that slightly exceeds r/R=1.0 (i.e., the trailing edge radius or nominal blade tip radius R). As shown in FIG. 10*a*, the prior-art fan has a max camber that decreases with increasing radial position from the root of the blade to an intermediate position, and then increases somewhat with increasing radial position from that intermediate position to the blade tip radius. This increase, which is gradual, starts at about r/R=0.7 and does not compensate for the nature of the leakage flow through the tip gap. The max camber at a radial position r where r/R=1.0 is only about 6 percent larger than the max camber at a radial position r where r/R=0.95.

The improved fan of FIG. 10*b* is designed according to certain aspects of the present invention with a modified tip geometry to account for the effects of the tip clearance. Both the max camber and the blade angle distributions increase significantly with increasing radial position r as the blade tip radius R is closely approached. The max camber at the blade tip radius (r/R=1.0) is about 40 percent larger than the max camber at a radial position r where r/R=0.95. Also, the blade angle at the blade tip radius R is about 0.054 radians greater than the blade angle at a radial position where r/R=0.95. At the blade tip radius R, the max camber-to-diameter ratio is about 0.02 and the chord-to-diameter ratio is about 0.20, so the max camber-to-chord ratio is about 0.10.

Figure 11A:
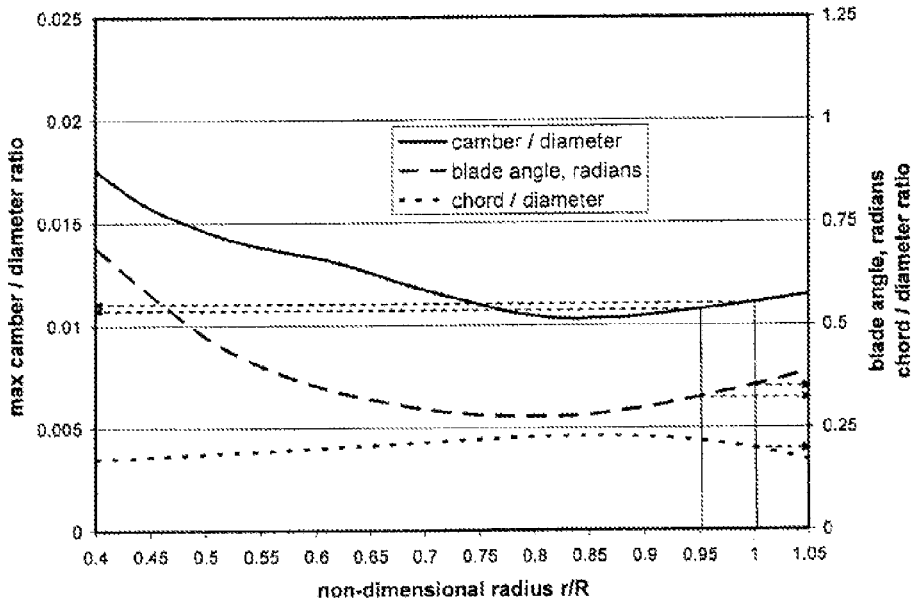
Figure 11a Prior Art
FIG. 11*a* and 11*b* show plots of maximum camber, blade angle, and chord as a function of radial position for another prior-art free-tipped fan and an improved free-tipped fan according to the present invention.

Data representative of yet another prior art fan is provided in FIG. 11*a*. As shown in FIG. 11*a*, this particular prior art fan has a max camber and a blade angle that decrease with increasing radial position r from the root of the blade to an intermediate position. Both quantities then increase with increasing radial position r from that intermediate position to the blade tip. The increase in these quantities, which starts between about r/R=0.80 and about r/R=0.85, is gradual and does not compensate for the nature of the leakage flow through the tip gap. The max camber at the blade tip radius (r/R=1.0) is only about 3 percent larger than the max camber at a radial position r where r/R=0.95, and the blade angle at the blade tip radius R is only about 0.029 radians larger than the blade angle at a radial position r where r/R=0.95.

Figure 11B:
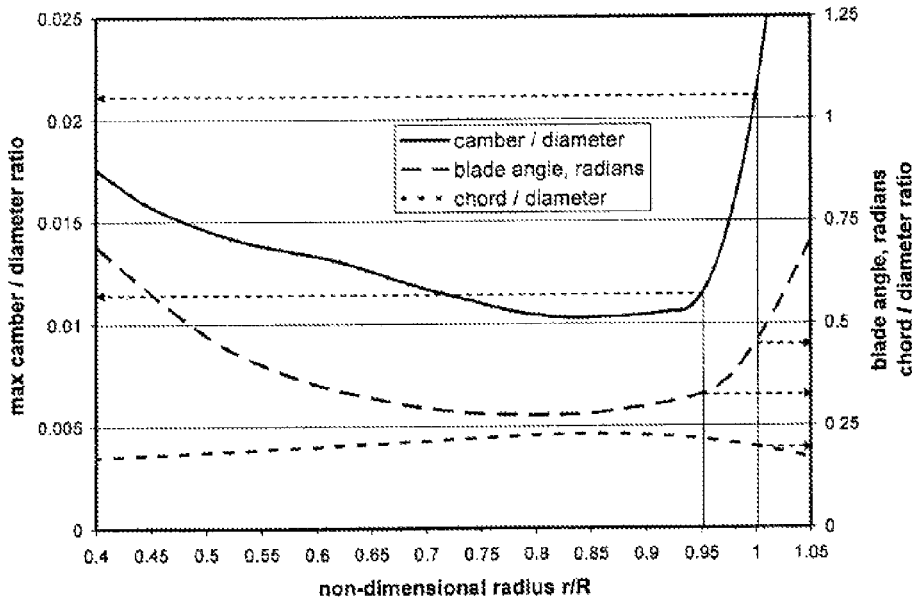

The improved fan of FIG. 11*b* is designed according to certain aspects of the present invention with a modified tip geometry to account for the effects of the tip clearance. Both the max camber and the blade angle distributions increase significantly with increasing radial position r as the blade tip radius R is closely approached. The max camber at the blade tip radius (r/R=1.0) is about 85 percent larger than the max camber at a radial position r where r/R=0.95. The blade angle at the blade tip radius is about 0.13 radians greater than the blade angle at a radial position r where r/R=0.95. At the blade tip radius, the max camber-to-diameter ratio is about 0.021 and the chord-to-diameter ratio is about 0.20, so the max camber-to-chord ratio is about 0.105.

Each of the fan blade profiles represented by the graphs of FIGS. 9*b*, 10*b*, and 11*b* includes an abrupt and significant increase in the maximum camber with increasing radial position r as the blade tip radius R is closely approached to account for or overcome the effects of the tip vortex created when running the fan inside a shroud with a tip gap between the fan blades and the shroud barrel. For example, a 10 percent or greater increase in max camber may occur in the final 10 percent or even the final 5 percent of the blade tip radius R as the radial position r increases toward the blade tip radius R. Although in the examples above there is also a significant increase in the blade angle with increasing radial position r as the blade tip radius R is closely approached, this is not necessarily a requirement of the invention.

The curves in FIGS. 9*a*-11*b* do not show the stacking line parameters skew and rake. The corrections to the blade tip geometry which correct for the effect of the tip gap are to a large extent independent of these parameters. Fan assemblies having properties according to one or more aspects of the present invention can be forward-skewed, back-skewed, radial, or of a mixed-skew design. Similarly, fan assemblies according to one or more aspects of the present invention can have any rake distribution, and may be of either a pusher or a puller configuration. Although the curves in FIGS. 9*a*-11*b* begin at a hub ratio of 0.4, fan assemblies having properties according to one or more aspects of the present invention can have hub ratios smaller or larger than 0.4.

What is claimed is:

1. A free-tipped axial fan assembly comprising:

a fan comprising a plurality of generally radially extending blades, each of the plurality of blades having a leading edge, a trailing edge, and a blade tip; and a shroud comprising a shroud barrel surrounding at least a portion of the blade tips with a tip gap being defined between the shroud barrel and the blade tips;

wherein the fan has a blade tip radius R and a diameter D equal to twice the blade tip radius R;

wherein each of the plurality of blades has a sectional geometry which at every radial position has a mean line, the mean line having a chord length, a blade angle, and a camber distribution, the camber distribution having a maximum camber;

characterized in that the maximum camber at the blade tip radius R is at least 10 percent larger than the maximum camber at a radial position r where r/R=0.95, and that from a radial position r where r/R=0.95 to the blade tip radius R, the blade angle increases by at least 0.01 radians.

2. The free-tipped axial fan assembly of claim 1 further characterized in that the maximum camber at the blade tip radius R is at least 20 percent larger than the maximum camber at a radial position r where r/R=0.95.

3. The free-tipped axial fan assembly of claim 1 further characterized in that the maximum camber at the blade tip radius R is at least 30 percent larger than the maximum camber at a radial position r where r/R=0.95.

4. The free-tipped axial fan assembly of claim 1 further characterized in that the maximum camber divided by the chord length at the blade tip radius R is at least 0.06.

5. The free-tipped axial fan assembly of claim 1 further characterized in that from a radial position r where r/R=0.95 to the blade tip radius R, the blade angle increases by at least 0.02 radians.

6. The free-tipped axial fan assembly of claim 5 further characterized in that from a radial position r where r/R=0.95 to the blade tip radius R, the blade angle increases by at least 0.04 radians.

7. The free-tipped axial fan assembly of claim 1 further characterized in that the shroud barrel is flared, and the blade tip leading edge is at a larger radius than the blade tip trailing edge.

8. The free-tipped axial fan assembly of claim 1 further characterized in that the tip gap is greater than about 0.007 times the fan diameter D and less than about 0.02 times the fan diameter D.

9. A free-tipped axial fan assembly comprising:

a fan comprising a plurality of generally radially extending blades, each of the plurality of blades having a leading edge, a trailing edge, and a blade tip; and a shroud comprising a shroud barrel surrounding at least a portion of the blade tips with a tip gap being defined between the shroud barrel and the blade tips;

wherein the fan has a blade tip radius R and a diameter D equal to twice the blade tip radius R;

wherein each of the plurality of blades has a sectional geometry which at every radial position has a mean line, the mean line having a chord length, a blade angle, and a camber distribution, the camber distribution having a maximum camber;

characterized in that the maximum camber at the blade tip radius R is at least 10 percent larger than the maximum camber at a radial position r where r/R=0.95, and that the maximum camber at the blade tip radius R is greater than or equal to the maximum camber at all other radial positions along the blade.

10. The free-tipped axial fan assembly of claim 9 further characterized in that the maximum camber at the blade tip radius R is at least 20 percent larger than the maximum camber at a radial position r where r/R=0.95.

11. The free-tipped axial fan assembly of claim 9 further characterized in that the maximum camber at the blade tip radius R is at least 30 percent larger than the maximum camber at a radial position r where r/R=0.95.

12. The free-tipped axial fan assembly of claim 9 further characterized in that the maximum camber divided by the chord length at the blade tip radius R is at least 0.06.

13. The free-tipped axial fan assembly of claim 9 further characterized in that from a radial position r where r/R=0.95 to the blade tip radius R, the blade angle increases by at least 0.01 radians.

14. The free-tipped axial fan assembly of claim 9 further characterized in that from a radial position r where r/R=0.95 to the blade tip radius R, the blade angle increases by at least 0.02 radians.

15. The free-tipped axial fan assembly of claim 9 further characterized in that from a radial position r where r/R=0.95 to the blade tip radius R, the blade angle increases by at least 0.04 radians.

16. The free-tipped axial fan assembly of claim 9 further characterized in that the shroud barrel is flared, and the blade tip leading edge is at a larger radius than the blade tip trailing edge.

17. The free-tipped axial fan assembly of claim 9 further characterized in that the tip gap is greater than about 0.007 times the fan diameter D and less than about 0.02 times the fan diameter D.

* * * * *